United States Patent [19]

Aileo

[11] Patent Number: 4,748,694

[45] Date of Patent: Jun. 7, 1988

[54] SPRING DEVICE FOR EARCUP ASSEMBLIES OF PROTECTIVE HELMET

[75] Inventor: Jackson A. Aileo, Carbondale, Pa.

[73] Assignee: Gentex Corporation, Carbondale, Pa.

[21] Appl. No.: 47,336

[22] Filed: May 7, 1987

[51] Int. Cl.[4] ..... A42B 3/00

[52] U.S. Cl. ..... 2/423; 2/209

[58] Field of Search ..... 2/209, 423, 6, 10

[56] References Cited

U.S. PATENT DOCUMENTS

| | | | |
|---|---|---|---|
| 2,572,746 | 10/1951 | Mougel | 2/209 |
| 2,844,820 | 7/1958 | Austin et al. | 2/423 X |
| 2,893,011 | 7/1959 | Finken et al. | 2/423 |
| 3,108,282 | 10/1963 | Rehman et al. | 2/209 X |
| 3,308,480 | 3/1967 | Elder | 2/209 |
| 3,400,406 | 9/1968 | Aileo | 2/209 X |
| 3,786,519 | 1/1974 | Aileo | 2/209 X |
| 3,864,756 | 2/1975 | Desimone | 2/209 X |
| 4,259,747 | 4/1981 | Taesler et al. | 2/6 |

FOREIGN PATENT DOCUMENTS

| | | | |
|---|---|---|---|
| 0447760 | 4/1948 | Canada | 2/209 |
| 1174258 | 12/1969 | United Kingdom | 2/423 |
| 1333012 | 10/1973 | United Kingdom | 2/209 |

*Primary Examiner*—Peter Nerbun

*Attorney, Agent, or Firm*—Shenier & O'Connor

[57] ABSTRACT

An improved binaural earcup assembly for use with a protective helmet in which the earphone of each of the left and right sound attenuating subassemblies is supported by a relatively rigid member in the hard outer shell of the subassembly at a location adjacent to the wearer's ear and in which the subassemblies are urged firmly into sealing engagement with the wearer's head in the region surrounding his ears by a resilient wire form having a pair of loops detachably connected to the earcup assemblies and biasing portion extending between the loops around the nape portion of the helmet.

4 Claims, 2 Drawing Sheets

SPRING DEVICE FOR EARCUP ASSEMBLIES OF PROTECTIVE HELMET

FIELD OF THE INVENTION

The invention is in the field of protective helmets and more specifically the field of sound attenuating earcup assemblies of protective helmets.

BACKGROUND OF THE INVENTION

There are known in the prior art protective helmets equipped with sound attenuating earcup assemblies which permit of communication through earphones. Assemblies of this type are adapted to protect the head of the wearer against impacts while at the same time protecting the ears of the wearer against the effect of ambient noise. Each of the earcup assemblies is provided with an earphone which permits the wearer to receive messages over a radio link or over a local communications system. One example of such a protective helmet is shown and described in Aileo U.S. Pat. No. 3,786,519, issued Jan. 22, 1974, for headgear structure.

The protective helmet shown in the Aileo patent includes an inner flexible helmet formed of a resilient material, such for example as "Nomex". It is provided with a pair of openings, each of which receives the hard sound attenuating body of an earcup assembly carrying a relatively soft sealing member adapted to engage the wearer's head around his ear. In the Aileo arrangement the construction and configuration of the helmet effects the earcup seal as the helmet is donned. More specifically, as the helmet is donned the nape is adjusted and the chin strap is secured. In the course of these operations the resilient mesh material causes the earcup assemblies to move into sealing engagement with the wearer's head. Ideally 50% compression of the ear seal against the head is achieved. The Aileo helmet comprises a hard outer shell secured to the flexible inner helmet and extending over most of the inner helmet outside the earcup assemblies.

While the earcup sealing arrangement described in the Aileo patent functions satisfactorily in the manner described above for a relatively long period of time in use of the helmet, ultimately the resilient material of which the inner helmet is formed loses its elasticity. When this occurs, adjustment of the nape and chin straps in the course of donning the helmet may actually move the earcups away from the head, thus rendering communications ineffective. The loss of resilience of the inner helmet material occurs before the helmet has outlived its usefulness as a protective helmet. It is obviously desirable that some means be provided for effecting the seal between the wearer's head and the earcup assemblies after the mesh material of the inner helmet has lost its inherent resiliency. It is further desirable that this be achieved without contacting the hard outer shell so that the acoustic isolation of the earcup assemblies can be maintained.

SUMMARY OF THE INVENTION

One object of my invention is to provide a device for effecting the sealing of earcup assemblies of a protective helmet with the wearer's head.

Another object of my invention is to provide a protective helmet earcup assembly sealing device which can be retrofitted to existing protective helmets without requiring structural changes.

A further object of my invention is to provide a protective helmet earcup assembly sealing device which can be applied to the earcup assemblies without the use of tools.

Still another object of my invention is to provide a protective helmet earcup assembly sealing device which accomplishes its object without detracting from the acoustic isolation of the earcup assemblies.

BRIEF DESCRIPTION OF THE DRAWINGS

In the accompanying drawings to which reference is made in the instant specification and which are to be read in conjunction therewith, and in which like reference characters are used to indicate like parts in the various views.

DESCRIPTION OF THE PREFERRED EMBODIMENT

Figure 1:
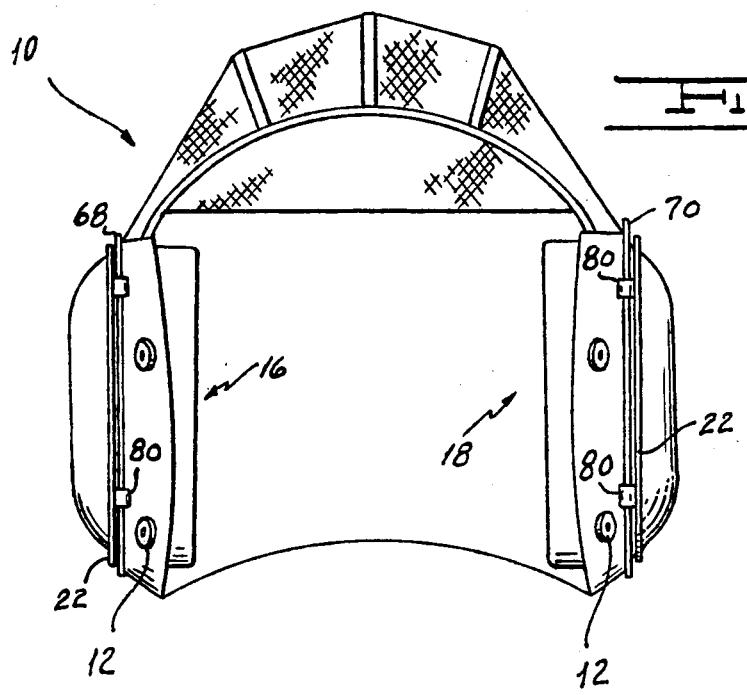
FIG. 1 is a front elevation of a protective helmet provided with my improved earcup assembly.
Figure 2:
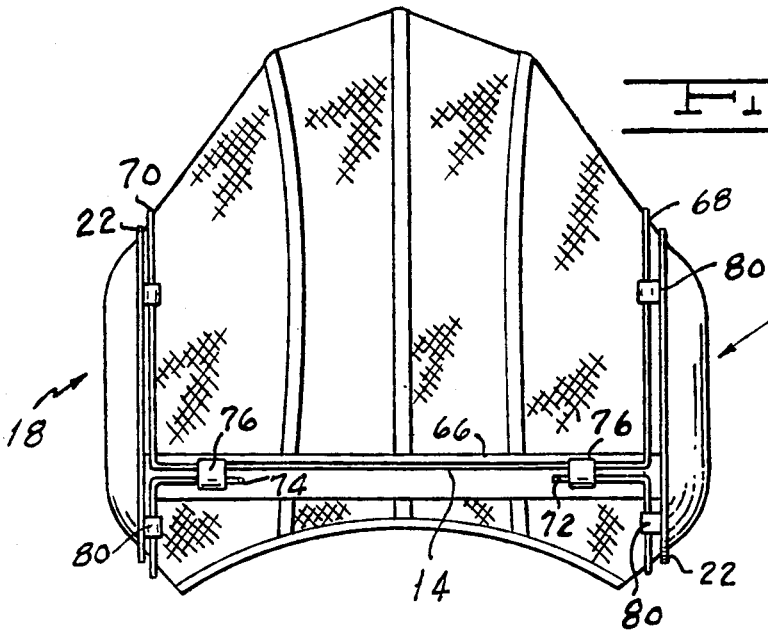
FIG. 2 is a rear elevation of the helmet shown in FIG. 1.

Referring now to FIGS. 1 and 2 of the drawings, the helmet indicated generally by the reference character 10 with which my improved earcup assembly is employed, is of the same type as that shown and described in the Aileo patent referred to hereinabove. It includes a pair of chinstrap fastener elements 12 and a nape strap 14, as well as respective right-hand and left-hand earcup assemblies indicated generally by the reference characters 16 and 18. As is more fully described in the Aileo patent, one of the assemblies 16 or 18 is provided with a fitting for supporting a boom carrying a microphone while the other of the two assemblies is provided with a switch for enabling the user to switch between a local communications circuit, for example, and a radio circuit. Since these elements per se do not form any part of my invention, they will not be described in detail.

Figure 3:
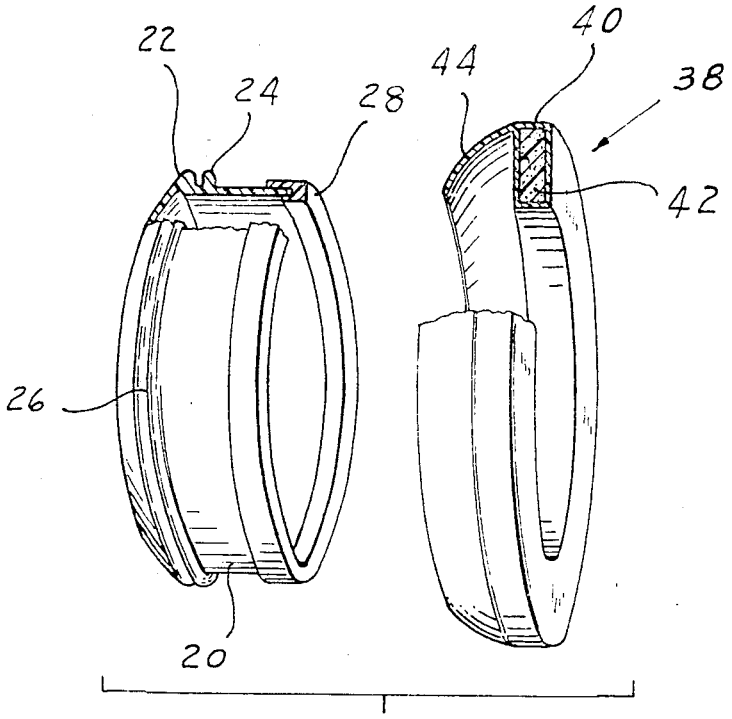
FIG. 3 is an exploded view illustrating the earcup assembly of the helmet illustrated in FIGS. 1 and 2.

Referring now to FIG. 3, I have shown the components of the assembly 18, it being understood that the components of the assembly 16 are substantially the same. The assembly 18 includes a hard outer shell 20 molded from a suitable synthethic resin and formed with a pair of annular ridges 22 and 24 forming a groove 26 by virtue of which the earcup assembly can be positioned in an opening in the helmet 10 in a manner known to the art. An end flange 28 which may be contoured to the shape of the wearer's head around his ear and which is molded from the same material as is the shell, is secured to the shell by a suitable adhesive. A $\frac{3}{8}$ inch thick spongy foam pad and a $\frac{5}{8}$ inch thick pad of the same material first are inserted in the cavity of the shell 20.

Figure 4:
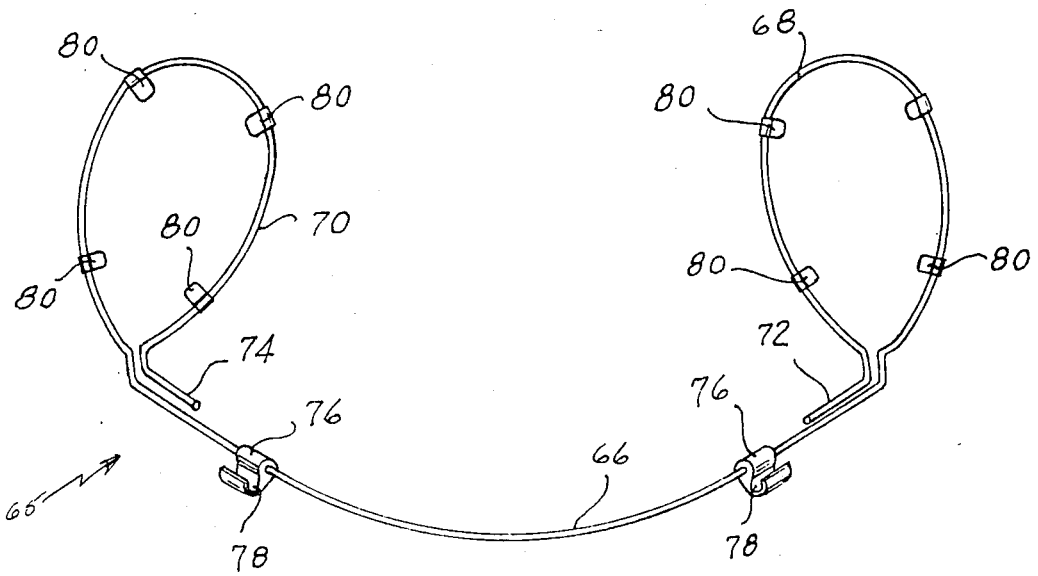
FIG. 4 is a plan of my spring device for the earcup assembly incorporated in the protective helmet illustrated in FIGS. 1 and 2.

Referring now to FIGS. 1, 2 and 4, our spring device for the earcup assembly is made up of a pressure wire form indicated generally by the reference character 65 having a central portion 66 extending between respective right-hand and left-hand loops 68 and 70. I turn the ends 72 and 74 of the wire at the free ends of the loops 68 and 70 inwardly so that they are oriented generally in the direction of the central portion 66 of the wire.

After the earcup assemblies 16 and 18 have been properly positioned on the helmet 10, the respective loops 68 and 70 are extended around the earcup assemblies 16 and 18. I provide each of the loops with a plurality of spaced lugs 80 adapted to the position behind the ridge 22 of the respective shell 20. I provide the form 65 with a pair of retainers 76 adapted to be slid along the wire portion 66. Each of the retainers 76 has a recess 78 into which one of the wire ends 72 and 74 is adapted to be snapped. When this has been done, and with the lugs 80 positioned behind the ridges 22, the wire form is securely held in place. In this condition of the parts, the inherent resiliency of the wire biases the earcup assemblies 16 and 18 to positions at which the end cushions 40 are firmly in engagement with the portion's of the wearer's head around his ears. Thus, an extremely effective seal is formed and the sound attenuating properties of the assemblies are enhanced.

It will be seen that I have accomplished the objects of my invention. I have provided a device for effectively sealing the earcup assemblies of a protective helmet to the wearer's head. My device can be applied to earcup assemblies without the use of tools. It does not detract from the acoustic isolation of the assemblies.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for protecting the head of a wearer against injury while shielding his ears from high levels of ambient noise including in combination, a flexible helmet adapted to fit relatively closely to the wearer's head, a pair of right and left earcup assemblies supported on said helmet adjacent to the wearer's ears, sealing means around the periphery of each of said earcup assemblies adapted to engage the respective regions of the wearer's head around his ears and to form acoustic seals therewith, and means acting independently of said helmet for biasing said earcup assemblies toward the wearer's head to cause said sealing means to form said seals, said biasing means comprising a wire form having a pair of loops detachably connected to the earcup assemblies, said wire form including a biasing portion extending between said loops, each of said loops extending from said biasing portion to a free end of said wire form and means for detachably connecting said free ends to said biasing portion.

2. Apparatus as in claim 1 in which each of said earcup assemblies comprises an outer shell formed with a peripheral groove and in which said connecting means comprises lugs on said loops engaging in said grooves.

3. Apparatus for protecting the head of a wearer against injury while shielding his ears from high levels of ambient noise including in combination, a flexible helmet adapted to fit relatively closely to the wearer's head, a pair of right and left earcup assemblies supported on said helmet adjacent to the wearer's ears, sealing means around the periphery of each of said earcup assemblies adapted to engage the respective regions of the wearer's head around his ears and to form acoustic seals therewith, and means acting independently of said helmet for biasing said earcup assemblies toward the wearer's head to cause said sealing means to form said seals, said biasing means comprising a wire form having a pair of loops and means detachably connecting said loops to said earcup assemblies, each of said earcup assemblies comprising an outer shell formed with a peripheral groove, said connecting means comprising lugs on said loops engaging in said grooves.

4. Apparatus for use with a protective helmet carrying a pair of earcup assemblies, each of which has a shell with a peripheral groove, said apparatus including a resilient form having a pair of loops connected by a central portion for biasing said loops toward each other, each of said loops extending from said central portion to a free end, means for detachably connecting said free ends to said central portion, said loops adapted to extend around said shells, and means on said loops for engaging in said grooves.

* * * * *